United States Patent [19]

Lai

[11] 4,089,195

[45] May 16, 1978

[54] MANACLES

[76] Inventor: I-Chen Lai, 3rd Fl., 5 Lane 6, Chao-Yang Street, West District, Taichung City, China /Taiwan

[21] Appl. No.: 809,679

[22] Filed: Jun. 24, 1977

[51] Int. Cl.[2] ..... E05B 75/00

[52] U.S. Cl. ..... 70/16; 361/232

[58] Field of Search ..... 70/16, 17, 15; 119/145; 361/232

[56] References Cited

U.S. PATENT DOCUMENTS

| | | | |
|---|---|---|---|
| 1,110,686 | 9/1914 | Heflin | 119/145 |
| 1,915,721 | 6/1933 | Diaz | 361/232 |
| 3,618,345 | 11/1971 | Smith | 70/16 |
| 3,885,576 | 5/1975 | Symmes | 361/232 |
| 3,889,163 | 6/1975 | Symmes | 361/232 |
| 3,998,209 | 12/1976 | MacVaugh | 361/232 |

*Primary Examiner*—Robert L. Wolfe

*Attorney, Agent, or Firm*—McGlew and Tuttle

[57] ABSTRACT

An improved manacle comprising two wristlet casings connected by a hinge, a receiver secured in one of said casings to receive the control signal from a transmitter, and an electric discharger to produce an electric shock voltage characterizing in said control signal is received by the receiver and converted to control said discharger to produce a high voltage shock to the prisoner with the manacle through an electrode, and in said hinge connecting the casings comprises a channel through the hinge body and the T-shaped connectors for the lead wires connecting circuits in the wristlet casings to pass without damage.

5 Claims, 8 Drawing Figures

MANACLES

BACKGROUND OF THE INVENTION

The present invention relates to an improved manacle particularly to one with electric shock means which is remotely controlled.

In the modern society, humanity is a word noticed and emphasized by most people. It is usually seen in public that a security guard or policeman shackles a suspect or prisoner by both his hands with the manacles. Said way of watching or carrying prisoners does effect the dignity of human and also threaten the life security of the policemen themselves.

BRIEF SUMMARY OF THE INVENTION

It is the primary object of the present invention to equip an electric shock means within the conventional manacles to produce an electric shock to the wrist of the prisoner if the guards find him try to escape. Said electric shock means is controlled by the guards with a transmitter within a certain distance about fifty meters. The electric shock is a discontinous one about 2,000 volts in voltage with discharge current from 1.5 to 3.0 milli-amperes to shock the prisoners preventing them from escaping.

Another object of the present invention is to provide a hinge connecting two wristlets of the manacle, with a channel formed therein for receiving the lead wires of the electric shock means avoiding damage of said wires when the manacle is folded or turned about the hinge.

BRIEF DISCRIPTION OF THE DRAWINGS those and other objects and advantages according to the present invention will become apparent from the following detailed description of the preferred embodiment with reference to the accompanying drawings, wherein.

DETAILLED DESCRIPTION OF THE PREFERRED EMBODIMENT

Figure 1:
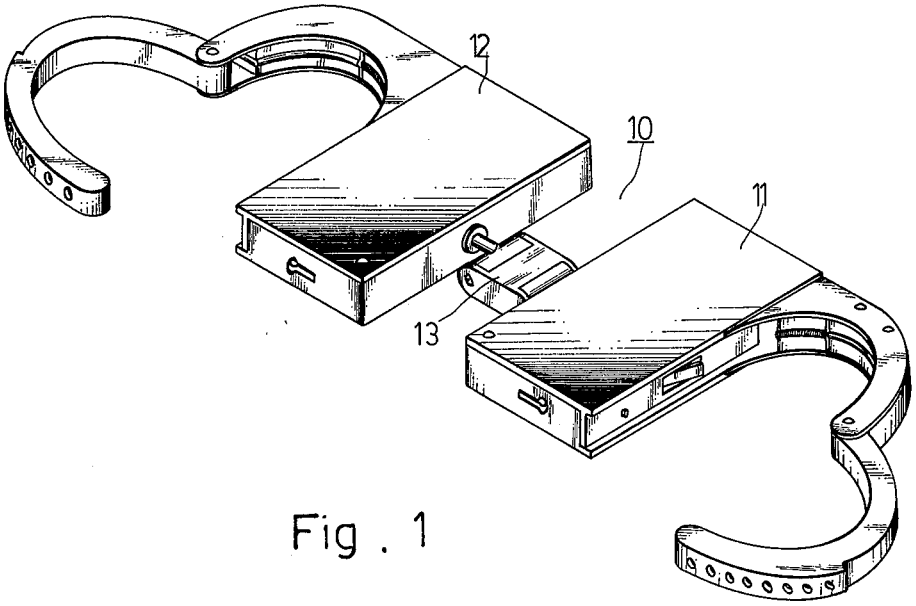
FIG. 1 is a perspective view of the manacle according to the present invention.
Figure 2:
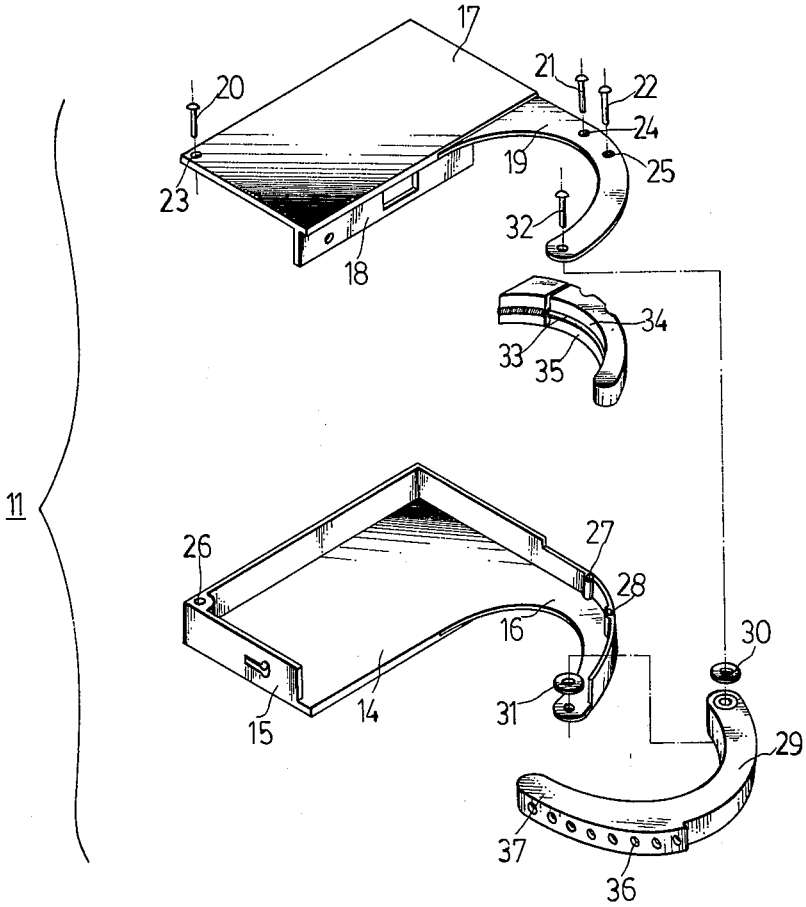
FIG. 2 is an exploded view of one wristlet casing of the manacle according to the present invention.

Referring to FIG. 1 where shows a perspective view of the manacle 10 which comprises two wristlet casings 11, 12 connected by a hinge 13. Said two casings 11 and 12 are identical in structure and only one of them the casing 11 is further exploded shown in FIG. 2 for a better description thereof. The wristlet casing 11 comprises a base 14 having a three-faced wall 15 and a first hooked portion 16 extending therefrom, a cover 17 having a side wall 18 and 2 second hooked portion 19 to be connected to said base 14 with screws 20, 21, 22 screwed through holes 23, 24, 25 thereof which are in alignment with the holes 26, 27, 28 of the base 14, and a movable hooked portion 29 clamped at one end thereof by said first hooked portion 16 and second hooked portion 19 and washers 30, 31 with a rivet 32 forming a pivotal joint. An electrode 33 is clamped by two insulators 34, 35 forming a combined assembly which is conformed with said first or second hooked portion in shape and adopted therebetween. A plurality of adjusting holes 36 are formed on the outer surface 37 of the movable hooked portion 29 for fitting various wrist sizes of the prisoners.

Figure 3:
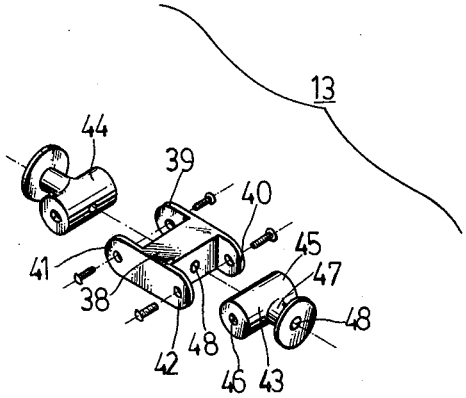
FIG. 3 is an exploded view of the hinge according to the present invention.

Referring to FIG. 3 where shows the exploded view of the hinge 13 which comprises a solid rectangular hinge body 38 having four protrusive plates 39, 40, 42 extending from the ends thereof with each said plate having a hole formed thereon and a pair of T-shaped connectors 43, 44 pivotally connected to said body by screws. The T-shaped connector 43 or 44 consists a first cylindrical portion 45 with a hole 46 drilled centrally and axially therein and a second cylindrical portion 47 with its one end welded radially on said first cylindrical portion 45 and another end welded to the wristlet casing on the base thereof. A channel 48 is formed axially through the second cylindrical portion 47, radially through the first cylindrical portion 45 on a middle portion thereof, and also through the hinge body 38 at the central portion thereof. This channel 48 is functioned for the lead wires connecting circuits in the wristlet casings to pass through.

Figure 4:
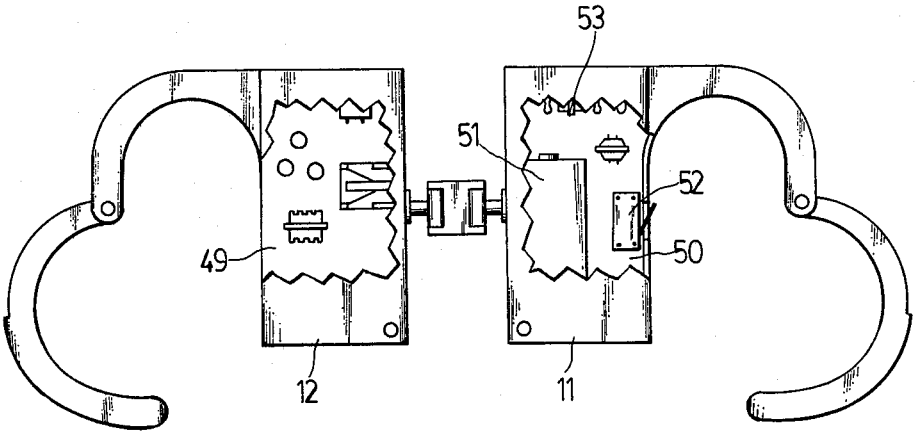
FIG. 4 is a front view of the manacle with the wristlet casings partly removed to show the layout of components of the receiver and the electric discharger.

Referring to FIG. 4 where shows the layout of the electric components of the receiver and the electric discharger in the wristlet casings. The receiver 49 is secured in the wristlet casing 12 while the electric discharger 50 which consists a battery 51 and a micro switch 52 for said receiver and an electric discharging circuit assembly 53 is secured in the wristlet casing 11.

Figure 5:
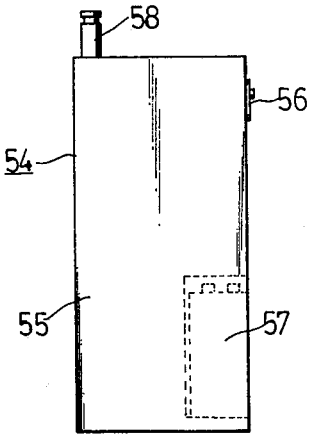
FIG. 5 is a side view of the transmitter to control the electric discharge of the manacle according to the present invention.

FIG. 5 shows the transmitter 54 which comprises a housing 55 with a micro switch 56 positioned thereon, a battery 57 and an antenna 58 formed therein.

Figure 6:
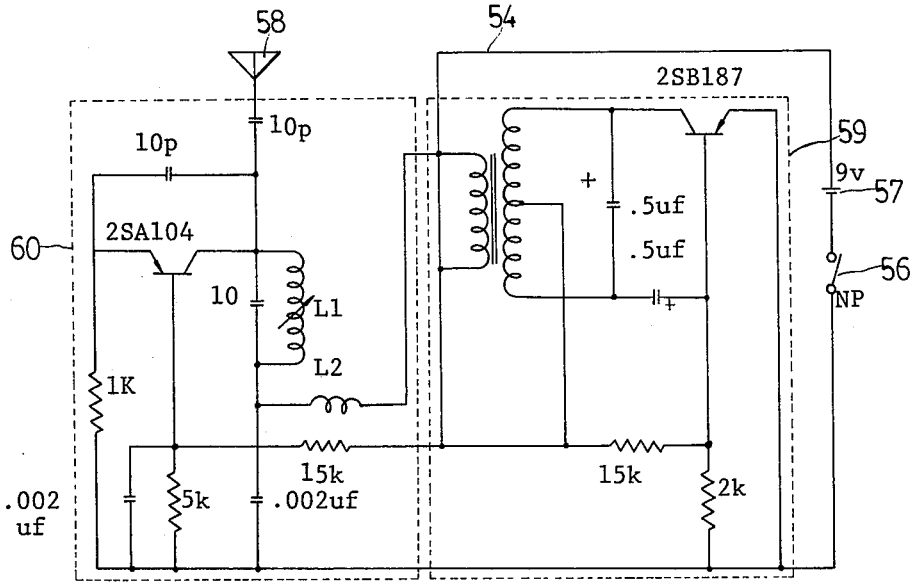
FIG. 6 is a circuit diagram of the transmitter.
Figure 7:
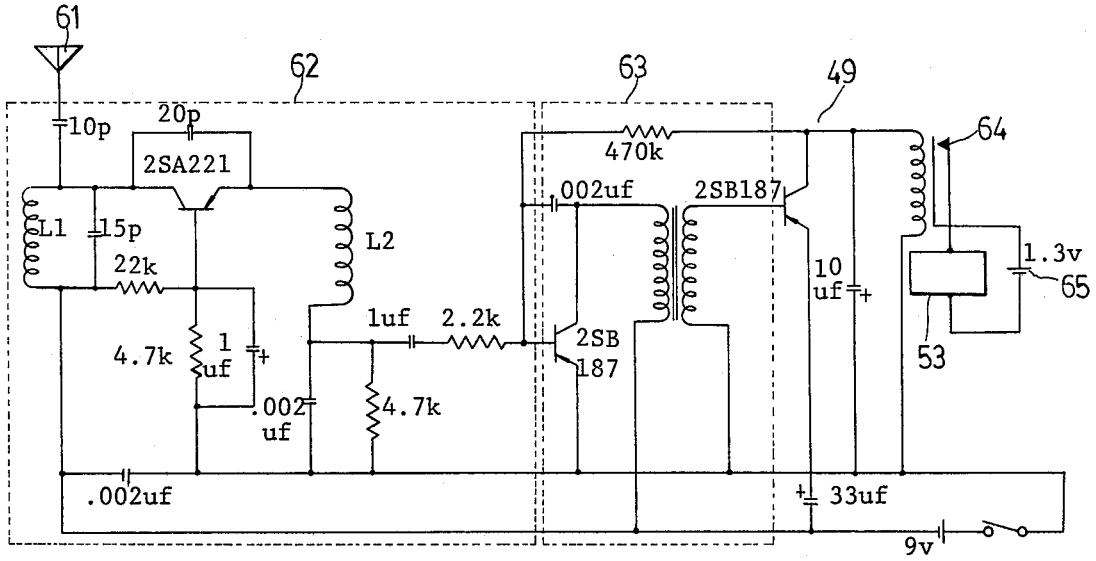
FIG. 7 is a circuit diagram of the receiver.
Figure 8:
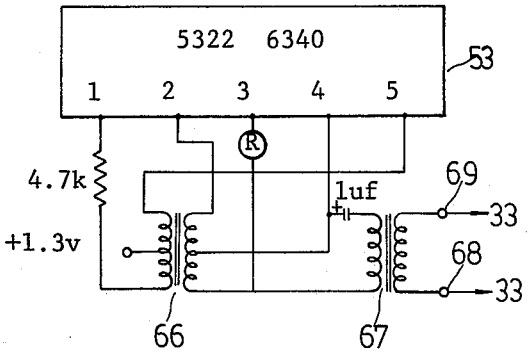
FIG. 8 is a circuit diagram of the electric discharger.

The circuit diagrams of the transmitter, the receiver and the electric discharger are shown by way of example in FIGS. 6, 7 and 8. The transmitter 54 in FIG. 6 is supplied by a nine volts battery 57, controlled with the micro switch 56, and further consists a low frequency signal generator 59 to produce the remote control signal which is carried by the high frequency carrier produced by the carrier circuit 60 and transmitted through the antenna 58. The receiver 49 in FIG. 7 is supplied by a battery 51, controlled with the micro switch 52, and further consists an receiving antenna 61, a high frequency local ossilator 62, a coupling transformer unit 63 and relay 64 to receive the control signal transmitted by said transmitter, step down the voltage and raise the current of said signal and operate said relay 64 to control the on off of the electric discharger 53. The electric discharging circuit assembly 53 in FIG. 8 comprises an integrated circuit for example IC number 5322, 6340, a coupling transformer 66 and an output transformer 67 to raise the voltage to a degree of 2000 volts with a current of 1.5 to 3 milli amperes. Said output voltage is connected to the electrode 33 in the hooked portion of the wristlet casing from two output leads 68 and 69.

In operation, the manacles can be locked to the wrist of one of the prisoner's hand. The receiver in the manacles is on when the micro switch thereof is operated. The guard holding a transmitter can in case occassion switch on the later to send a signal to be received by the receiver in the manacles, producing an electric shock to the prison if he intends to escape. It is to be noted that the electric shock will not harm the life of the prisoner.

What I claim is:

1. An improved manacle comprising two wristlet casings connected by a hinge, a receiver secured in one of said casings to receive the control signal from a transmitter, and an electric discharger controled by said control signal to produce an electric shock voltage applied to an electrode in a hooked portion of said casing whereby the electric shock is applied to the prisoner through said electrode if he is locked with the manacle.

2. An improved manacle according to claim 1 wherein said hinge to connect two wristlet casings comprises a solid rectangular hinge body having four protrusive plates extending from the ends thereof with each said plate having a hole formed thereon, a pair of T-shaped connectors pivotally connected to said hinge body each further comprises a first cylindrical portion with a hole drilled centrally and axially therein and a second cylindrical portion with its one end welded radially on said first cylindrical portion, and a channel formed axially through the T-shaped connectors and the hinge body for the lead wires connecting circuits in the wristlet casings to pass without damage.

3. An improved manacle according to claim 1 wherein said transmitter supplied by a battery and controlled with a micro switch, consists a low frequency signal generator to produce an ossilated signal which is carried by a high frequency carrier and transmitted through an antenna.

4. An improved manacle according to claim 1 wherein said electrode is clamped by two insulators forming a combined assembly which is conformed in shape with the hooked portion of the wristlet casing and adopted therein to receive the output shock voltage produced by the discharger and transfer the same to the wrist of the prisoner who is locked with the manacle.

5. An improved manacle according to claim 1 wherein said receiver comprises a micro switch which is equipped on the wall of the wristlet casing and controlled to be on when the movable hooked portion is locked to the casing.

* * * * *